United States Patent [19]

Lowery

[11] 4,365,386

[45] Dec. 28, 1982

[54] HINGE DOOR ASSEMBLY

[76] Inventor: John L. Lowery, 1864 Country Club Dr., Baton Rouge, La. 70808

[21] Appl. No.: 239,906

[22] Filed: Mar. 3, 1981

[51] Int. Cl.[3] ..... E05C 5/06; E05F 1/10

[52] U.S. Cl. ..... 16/382; 49/380

[58] Field of Search ..... 16/385, 389, 382, 248; 49/380, 397

[56] References Cited

U.S. PATENT DOCUMENTS

| | | | |
|---|---|---|---|
| 3,065,496 | 11/1962 | Loughlin | 49/380 |
| 3,067,452 | 12/1962 | Wagner | 16/382 |
| 3,164,228 | 1/1965 | Segre | 49/397 |
| 4,297,812 | 11/1981 | McPhail | 49/380 |

*Primary Examiner*—Werner H. Schroeder
*Assistant Examiner*—Andrew M. Falik
*Attorney, Agent, or Firm*—Llewellyn A. Proctor

[57] ABSTRACT

A hinge for mounting a door to a door jamb in hinged relationship in a construction wherein the door and door jamb are formed from a longitudinally grooved frame wherein the elements forming the hinge can be fitted within the accommodating longitudinal grooves of said frame to provide the hinged relationship. Both of the hinge elements and frame are cut from longer lengths of extrudate metal stock. The hinge segments are of corresponding cross-section, each including tubular portions which can be fitted together in tandem and pivotally attached or pinned one segment to another, and key portions constituting male members capable of mating with accommodating female slots located in the frame to provide the hinged relationship between the door and door jamb.

7 Claims, 3 Drawing Figures

HINGE DOOR ASSEMBLY

Considerable ingenuity has been demonstrated in the design of hinges and hinged installations for pivotally attaching closure members across openings or entranceways to control ascess. Hinges are articulated joints, generally constituted of segments, one segment being bolted or otherwise secured upon the closure member (e.g. a hinge butt; or hinge leaf mounting member) and another upon the jamb of a frame surrounding the opening or entranceway (e.g. a hinge leaf), the segments containing aligned eyes, or openings through which a metal hinge pin is passed to pivotally connect the members. Hinges are generally used in pairs, or in multiple units to pivotally connect a closure member to a frame; and screws or bolts are generally used to connect the hinge segments to a frame, or jamb, and to an edge of the closure member.

The task of mounting hinges for attaching doors or panels to a jamb, particularly the jamb of a metal cabinet, is often quite difficult. Modern cabinets are generally constituted of metal. The frames of such cabinets, inclusive of the frame used to form the closure members, are often made of grooved elongate members made by the extrusion of a high strength lightweight metal, e.g. aluminum. The elongate members are fitted together by design to form the desired shapes, inclusive of jambs on which the closure members when completed can be pivotally secured. In the manufacture of such cabinets a precision is required which allows little room for error. In mounting hinges for attaching doors or panels to a door jamb, especially a metal cabinet, e.g., it is a rather difficult task to measure distances with the precision necessary to assure proper closure of the door, especially where the door or panel must fit, or mate precisely with the framed opening. This is particularly so in the construction of metal cabinets wherein the closure members, i.e. doors and panels, are cut to very close tolerances, and close within the frame of the cabinet to restrict ascess. Often mounting holes cut within the frame and closure member for precision fits are "off" perhaps only by a hair; even when the measurements are made, and the holes cut by experienced craftsmen. In such event, the holes must be closed and sealed, new measurements made, and new holes cut. The careful, precise measurements required for proper location of the hinges results in loss of time; and often loss of both time and material when errors are made, as inevitably occurs.

It is, accordingly, the primary objective of the present invention to provide a novel metal cabinet construction wherein the frame members which form the door jamb and closure member to be pivotally attached thereto are grooved, each for receipt of a segment of a metal hinge fitted therein or keyed therewith in a tongue-and-groove arrangement, and which can be adjusted at virtually any level or elevation to pivotally secure the closure member to the jamb without any necessity of preliminary precision measurements.

A specific object is to provide grooved extruded metal members of similar shape which can be cut into segments, and the segments fitted together to form frames for door jambs and four-sided closure members as portions of cabinets; and metal hinges, sections of which can be fitted into or keyed together with grooves on the jamb and closure member in tongue-and-groove fashion to couple and pivotally attach a closure member to a jamb, and the hinges then adjusted, and fixed to hold the door in precise position without any necessity of preliminary precision measurements.

A further and more specific object is to provide door frames, door jamb frames and hinges as characterized, the hinges being constituted of light metal or plastic hinge segments of corresponding cross-section which can be formed by cutting said segments from an extruded piece of light metal or plastic stock, and more particularly hinges as characterized which can be used in combination with interlocking door and door jamb frame members formed by cutting door and door jamb frame segments from an extruded piece of light metal or plastic stock.

These objects and others are achieved in accordance with this invention embodying apparatus inclusive of (1) hinges formed from hinge segments of corresponding cross-section, each hinge segment including tubular portions which can be fitted together in tandem and pivotally attached one to another via a pin passed through the openings of said tubular portions, and key portions constituting male members capable of mating with accomodating female slots located within the frame of a door or door jamb; and (2) frames for use in combination therewith useful for forming doors and door jambs which are provided with longitudinal grooves which can accommodate or be mated with the key portions of said hinge segments for pivotal attachment of a door to a door jamb.

In a preferred embodiment the tubular opening and key portion of a hinge segment are alternately disposed, a segment tubular opening being located on one side and the key portion on the other side of said hinge segment. The key portions of the hinge segments are preferably of cross section constituting planar edge members with projecting guide ribs separated from said tubular portions of the hinge segment by a webb portion; and most preferably the cross-section of the key portion of the hinge segment is substantially L-shaped. The cross-sectional configuration of a key portion of a hinge segment forms a male member substantially corresponding to a longitudinal groove located on the frame of a door or door jamb, the latter as it were forming a female slot within which the key portion, or male member of the hinge element is fitted for mounting a door to a door jamb.

These features and others will be better understood by reference to the following detailed description of the invention, and to the attached drawings to which reference is made. In the drawings, similar numbers are used to represent similar components in the different figures, and subscripts are used to designate a plurality of similar or analogous components.

Figure 1:
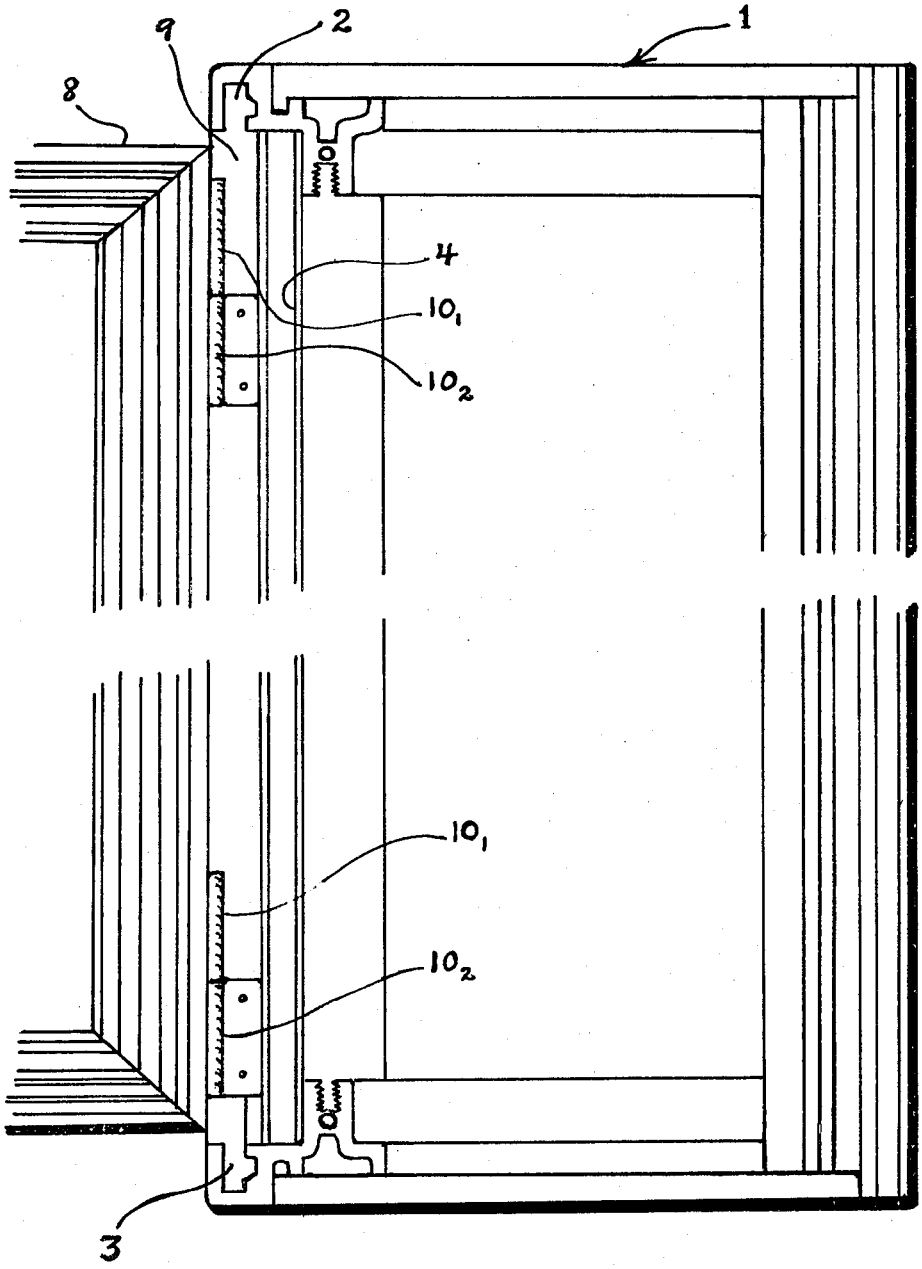
FIG. 1 depicts a view of a preferred type of structure, viz. a cabinet formed from extruded metal members, inclusive of extruded door, or door frame and hinges; the door and hinges being shown in association with a door jamb and wall forming a portion of the door jamb.

Referring first to FIG. 1 there is shown a segment of a metal cabinet constituted generally of a rigid, rectangular frame 1 inclusive of horizontal and vertical longitudinally grooved posts constituted of extruded metal segments, particularly light metals such as aluminum and other alluminum alloys. The formation of frame members from light metals by extrusion techniques provides, inter alia, uniformity of cross-section, and shape of the members for use in the construction of cabinets. Such members can be taken from a single length of extruded metal cut to the desired length at angles which permit adjacent ends of the frame members to be fitted together to abut and mate with the formation of right angle miter joints. The sections of the frame are covered with panels of various types, and materials of construction.

In the structure, a door 8 is hinged upon an extruded metal post constituting a door jamb 9 via a plurality of hinges 10 (constituted of hinge segments $\mathbf{10_1}$, $\mathbf{10_2}$). The hinges 10 are conveniently constituted of segments of light metal cut from a single length of metal extrudate of uniform cross-section, the segments preferably being cut as elongate shapes to provide paired segments $\mathbf{10_1}$, $\mathbf{10_2}$ which can be fitted together in tandem to form the hinges 10; the hinge segments preferably being cut at right angles one segment relative to another. In the construction of a cabinet, a door 8 is formed from a single metal extrudate of uniform cross-section, suitably grooved, and cut into four suitable lengths of 45° angles with the ends fitted together and mitered. The door 8 is hinged via hinges 10 by affixing segments of hinges to both the door 8 and door jamb 9. In installed position, hinge segments $\mathbf{10_2}$, constituting the lower side of a hinge 10 are set within the groove $\mathbf{9_1}$, of the door jamb 9. Initially, the hinge segments $\mathbf{10_1}$, $\mathbf{10_2}$ are loosely slidably placed within the groove $\mathbf{9_1}$, of the door jamb 9, their elevation being restricted only by the presence of metal members 2, 3 at each end of the groove $\mathbf{9_1}$ so that the hinge segments $\mathbf{10_2}$ cannot thereafter be removed, and a vertical member 4 is mounted between these members to form a backstop for the door 8. Hinge segments $\mathbf{10_1}$ are similarly loosely, slidably mounted within the groove $\mathbf{8_1}$ of the door 8, and the door 8. The hinge segments $\mathbf{10_1}$ and $\mathbf{10_2}$, respectively, are then hinged in place on the door 8 and door jamb 9, respectively, by pinning together the hinge segments $\mathbf{10_1}$, $\mathbf{10_2}$ of a respective hinge 10. The door is easily adjusted to the desired elevation or height by movements and adjustment of the segments $\mathbf{10_1}$, $\mathbf{10_2}$ of hinges 10. After correct positioning of the door 8 upon door jamb 9; and the proper or desired elevation of the hinges 10 is ascertained, the hinge segments $\mathbf{10_1}$, $\mathbf{10_2}$ can be secured tightly in place.

Figure 2:
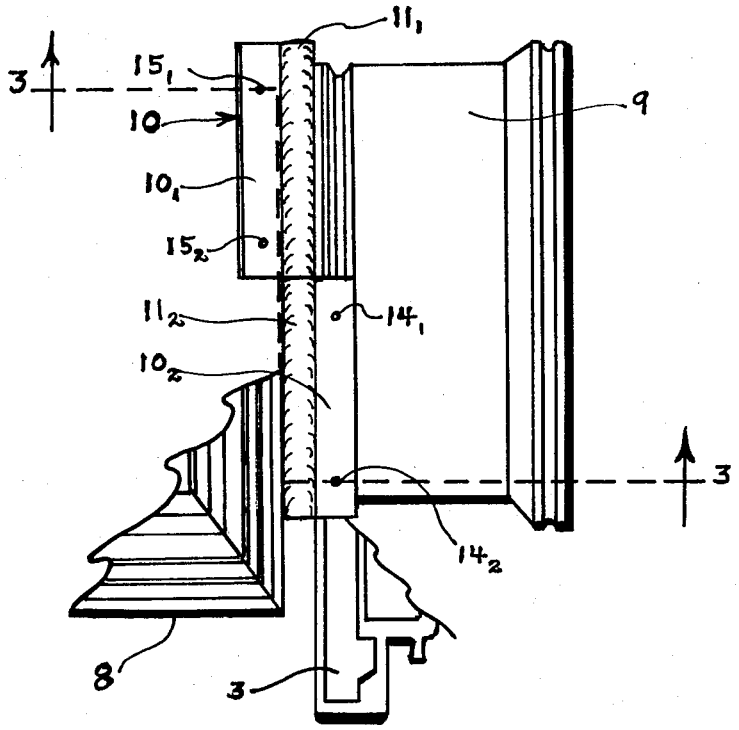
FIG. 2 depicts a preferred hinge, the hinge being shown in partial assembly with a fragmentary section of a door and door jamb; the hinge being depicted as employed to pivotally attach a door to a door jamb.
Figure 3:
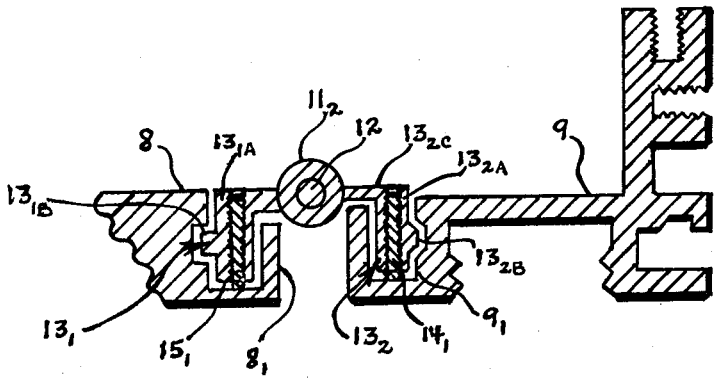
FIG. 3 is a cross-section taken through line 3—3 of FIG. 2 showing both the hinge, and fragmentary portion of the door and door jamb.

With particular reference to FIGS. 2 and 3 it will be observed that a hinge 10 is constituted of two corresponding, similar elongate segments $\mathbf{10_1}$, $\mathbf{10_2}$ or pairs of members, at one side of each of which is provided tubular openings $\mathbf{11_1}$, $\mathbf{11_2}$ through which a pin 12 can be passed to pivotally attach the paired members $\mathbf{10_1}$, $\mathbf{10_2}$ one to the other, and an opposite side providing offset, or key portions $\mathbf{13_1}$, $\mathbf{13_2}$ of generally L-shaped cross-section for slotted engagement with a door 8 and door jamb 9, respectively.

The segments $\mathbf{10_1}$, $\mathbf{10_2}$ of the hinge 10 are of identical cross-section, and conveniently can be cut from an extruded stock of longer length, i.e. metal, plastic or other material, e.g. an extruded elongate bar of aluminum. Each segment $\mathbf{10_1}$, $\mathbf{10_2}$ of the hinge 10 is thus constituted of tubular portions $\mathbf{11_1}$, $\mathbf{11_2}$ fitted together in end-to-end, or tandem relationship, and pivotally attached by means of pin 12 which is passed through said tubular openings $\mathbf{11_1}$, $\mathbf{11_2}$. Each segment $\mathbf{10_1}$, $\mathbf{10_2}$ is also constituted of key portions $\mathbf{13_1}$, $\mathbf{13_2}$ of L-shaped cross-section which fit into mating slots within the door 8 and door jamb 9, respectively, to pivotally attach, or hinge the door to said door jamb 9. Thus, the key portions $\mathbf{13_1}$, $\mathbf{13_2}$ constituted of planar edge members $\mathbf{13_{1A}}$, $\mathbf{13_{2A}}$ provided with projecting ribs $\mathbf{13_{1B}}$, $\mathbf{13_{2B}}$, separated from the tubular openings $\mathbf{11_1}$, $\mathbf{11_2}$ by web portions $\mathbf{13_{1C}}$, $\mathbf{13_{2C}}$ which are connected at right angles to the planar edge members $\mathbf{13_{1A}}$, $\mathbf{13_{2A}}$. The key portions $\mathbf{13_1}$, $\mathbf{13_2}$ fit, or mate with openings $\mathbf{8_1}$, $\mathbf{9_1}$ of the door 8 and door jamb 9 respectively; these openings providing main channels $\mathbf{8_1}$, $\mathbf{9_1}$ which receive the planar edge members $\mathbf{13_{1A}}$, $\mathbf{13_{2A}}$, and grooves $\mathbf{8_{1B}}$, $\mathbf{9_{1B}}$ which receive the projecting ribs $\mathbf{13_{1B}}$, $\mathbf{13_{2B}}$ of key portions $\mathbf{13_1}$, $\mathbf{13_2}$. Added stability is provided by sizing the lengths of the webbed portions $\mathbf{13_{1C}}$, $\mathbf{13_{2C}}$ to correspond generally with the width of the outside edges of the walls which form openings $\mathbf{8_1}$, $\mathbf{9_1}$.

A hinge can be secured in place to the door 8 and door jamb 9, respectively, by peeming or crimping the channels $\mathbf{8_1}$, $\mathbf{9_1}$ after hinge segments $\mathbf{10_1}$, $\mathbf{10_2}$ are adjusted to the desired level; or preferably set screws are used to secure the hinge segments $\mathbf{10_1}$, $\mathbf{10_2}$ in place. Typically a bottom segment $\mathbf{10_2}$ of a hinge 10 is secured in place within the channel $\mathbf{9_1}$ via set screws $\mathbf{14_1}$, $\mathbf{14_2}$ and the upper segment $\mathbf{10_1}$ is held in place and positioned atop the bottom segment $\mathbf{10_2}$ via the weight of the door 8, and it is secured to the door 8 via set screws $\mathbf{15_1}$, $\mathbf{15_2}$.

A feature of this invention is that the hinges can be installed, and then set in place within a door and door jamb without preliminary precision measurements or necessity of rabbiting the door and/or door frame to enable the hinge to flush with the frame or door, or of cutting holes at measured intervals within the door and door jamb for located and installation of the hinges. Thus, in a typical installation paired hinge segments are first slidably located within the grooved edges of the door and door jamb, respectively, and the paired members then pinned together to form completed hinges. The door is then set in its desired position relative to the door jamb, the elevation of the hinges are then adjusted to the level desired, and the hinges are then secured to the door and door jamb, respctively, by peeming, or tightening the hinges in place within the grooved edges of the door and door jamb, respectively, as by tightening the screws in place.

In the embodiments described, it will be observed that when hinge segments are cut from an extruded length of metal stock the segments if cut in similar lengths will all be identical, but after coupling by passage of a pin through the tubular openings of a pair of the segments to form a hinge 10 at the time of mounting a door upon a door jamb, the key portions of the segment pair are rotated, and rotatable about the pin. Whereas it is essential, of course, to employ not less than two of the hinge segments to form a hinge 10, three, or three or more hinge segments can be employed as may be required in the suspension of a very heavy door. Thus, a continuous series of the hinge segments can be employed and they can be spaced in any desired relationship. It is preferable however to employ the hinge segments in pairs, suitably in abutting relationship.

The hinges of this invention are particularly useful in the construction of metal cabinets, both the hinges and frames for which can be extruded conveniently from light metals, notably aluminum and other aluminum alloys. In particular, frames can be extruded which contain longitudinal grooves, inclusive especially grooves, or slots of L-shaped cross-section constituting female sections suitable for engagement with the L-shaped male cross-sections or key portions provided by the extruded hinge sections.

It is apparent that various modifications and changes can be made, e.g., as in the size, shape and materials of construction without departing the spirit and scope of the invention.

Having described the invention, what is claimed is:

1. Apparatus constituting a hinge for mounting a door to a door jamb in hinged relationship, the door jamb being formed from a longitudinally, edge grooved metal frame, which comprises a pin, a pair of hinge segments of identical cross-section, constituted of tubular portions fitted together in tendem and pivotally attached one to the other via said pin passed through the openings through each of said tubular portions, L-shaped projections connecting via a terminal end to and extending from said tubular portions, said L-shaped projections including webbed portions directly connected at right angles to said tubular portions, and planar edge members extended at right angles from said webbed portions to which said planar guide members are directly connected via a terminal end, said planar edge members including projecting guide ribs which, in combination with said planar edge members, form tongue-and-groove connections which mate with the edge groove of said door jamb whereby the door can be pivotally attached to said door jamb via said pair of hinged segments, and the lower of the hinged segments of the pair can serve as a support for the upper of the hinged segments of said pair.

2. The Apparatus of claim 1 wherein both the door and door jamb have included therein longitudinally, edge grooved metal frames, pairs of hinges in place, wherein the planar edge members with the projecting guide ribs of said hinge segments are fitted, pinned together and freely slidable within the longitudinal edge grooves of said door and door jamb, respectively, whereby the door can be set in its desired position within the door jamb, and the hinge segments thereafter affixed in place to install the door upon the door jamb without any necessity of preliminary measurements or necessity of cutting holes at measured intervals within the door and door jamb for location and installation of the hinges.

3. The Apparatus of claim 2 wherein the planar edge members of each of the hinge segments are provided with internally threaded openings, and the hinges are affixed in place via screws passed through said openings into said door and door jamb to affix the hinges.

4. The Apparatus of claim 1 wherein the hinge segments are cut from a longer length of the same exruded metal.

5. The Apparatus of claim 1 wherein the hinge segments are of substantially equal length.

6. The Apparatus of claim 1 wherein the hinge segments are of substantially equal length, and cut from a longer length of the same extruded metal.

7. The Apparatus of claim 6 wherein the hinge segments are constituted of aluminum or other alloy of aluminum.

* * * * *